US005228961A

United States Patent [19]

Sakai

[11] Patent Number: 5,228,961

[45] Date of Patent: Jul. 20, 1993

[54] PROCESS FOR ELECTRODEPOSITION COATING WORKS WITH PAINT

[75] Inventor: Hideyuki Sakai, Okazaki, Japan

[73] Assignee: Nichidai Industrial Co., Ltd., Aichi, Japan

[21] Appl. No.: 885,969

[22] Filed: May 20, 1992

[30] Foreign Application Priority Data

May 30, 1991 [JP] Japan ..... 3-155193

[51] Int. Cl.[5] ..... C25D 13/00

[52] U.S. Cl. ..... 204/180.2

[58] Field of Search ..... 204/180.2

[56] References Cited

U.S. PATENT DOCUMENTS 4,337,135 6/1982 Quinton ..... 204/213

4,812,211 3/1989 Sakai ..... 204/180.2

*Primary Examiner*—T. M. Tufariello

*Attorney, Agent, or Firm*—Lowe, Price, LeBlanc & Becker

[57] ABSTRACT

Monorail from which hangers are suspended move along a rail. Baskets containing works to be electrodeposition coated with paint are loaded in each hanger. Tanks are located below part of the rail. When the monorail has come to the position directly above each tank, the hanger is lowered into the tank. In the tank the works are treated with liquid while the hanger is rocked. Follwing the treatment, the hanger is raised out of the tank and is rocked again to drop into the same tank the liquid used in that tank and remaining on or in the works.

8 Claims, 9 Drawing Sheets

PROCESS FOR ELECTRODEPOSITION COATING WORKS WITH PAINT

FIELD OF THE INVENTION

This invention relates to a process for electrodeposition coating works, such as forgings or castings to be used for an automobile, with paint.

BACKGROUND OF THE INVENTION

In U.S. Pat. No. 4,812,211 the inventor has proposed a system for electrodeposition coating automobile parts with paint whereby a basket containing automobile parts, such as forgings or castings, is suspended from a basket carrier and is immersed in liquids in tanks. The basket is swung in each tank several times so that the entire surface of each work (automobile part) is treated with the liquid. Following the immersion of the works in all tanks, the basket is conveyed into a furnace in which the works are heated and dried.

In the prior art, however, when the basket has been immersed in the tank, the basket is conveyed into the next tank without intentionally dropping the liquid which was contained in the preceding tank and may remain on or in the works. Consequently, the works may carry the preceding liquid into the next liquid. This drawback is particularly great if the works have many or large inner spaces open to the outside. The more complicated forms parts have, the more or larger inner spaces open to the outside they tend to have. The more liquid from the preceding tank mixes with that in the next tank, the sooner the liquid in the next tank must be replaced with a new liquid.

SUMMARY OF THE INVENTION

It is an object of the invention to provide a process for electrodeposition coating automobile parts, such as forgings or castings, with paint whereby parts are rocked twice, i.e., first in a tank to treat the entire surface of each part with a liquid and then above the same tank to drop into that tank the liquid used in that tank and remaining in or on the parts.

BRIEF DESCRIPTION OF THE DRAWING

As shown in FIG. 5, according to the invention, the hanger H is rocked both in and above the tank;

DETAILED DESCRIPTION OF A PREFERRED EMBODIMENT

Figure 1:
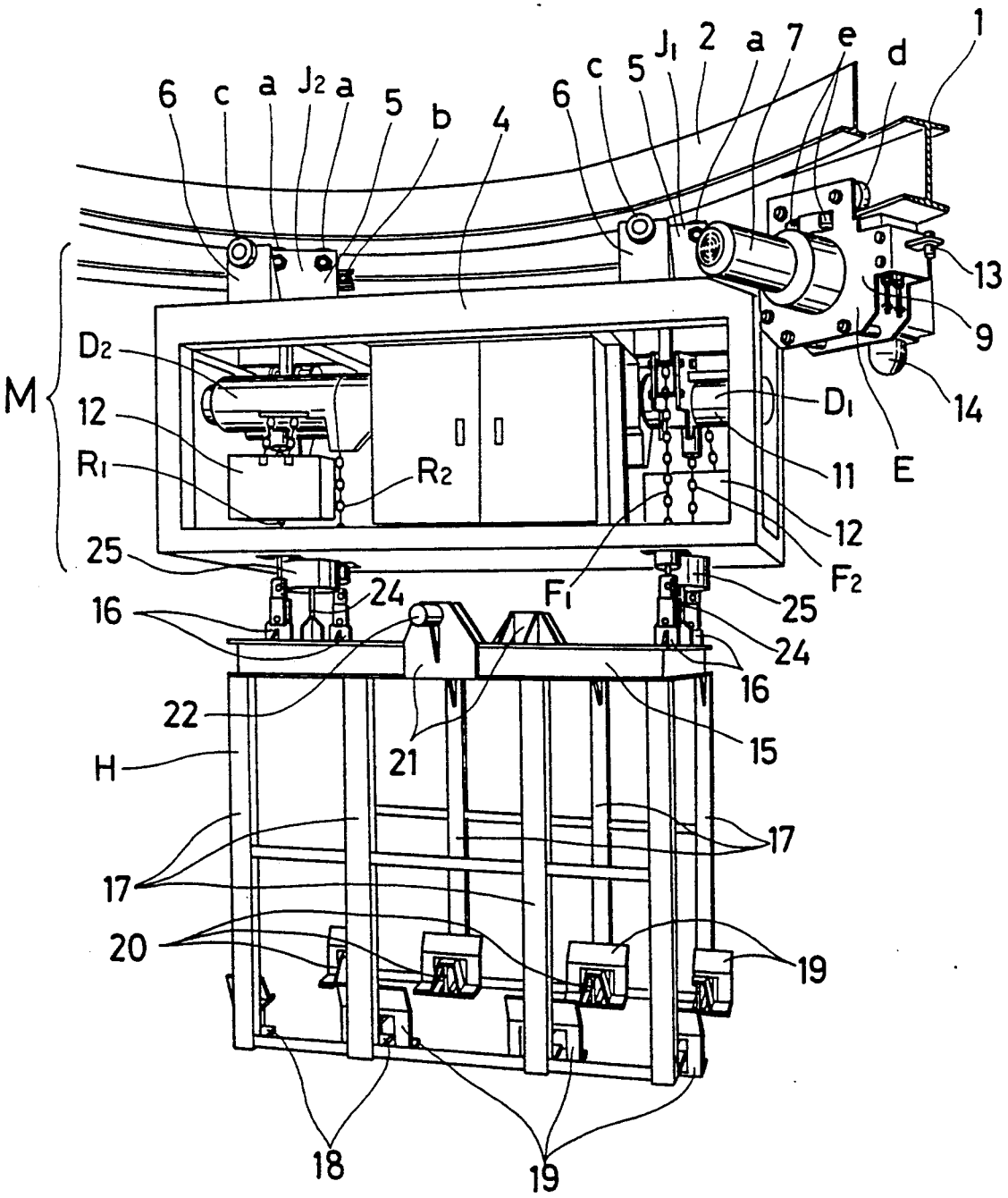
In FIG. 1 a monorail M from which a hanger H is suspended is moving along a curved portion of a rail 1.

An electrodeposition coating process which embodies the invention in one preferred form will now be described with reference to the drawing.

Figure 2:
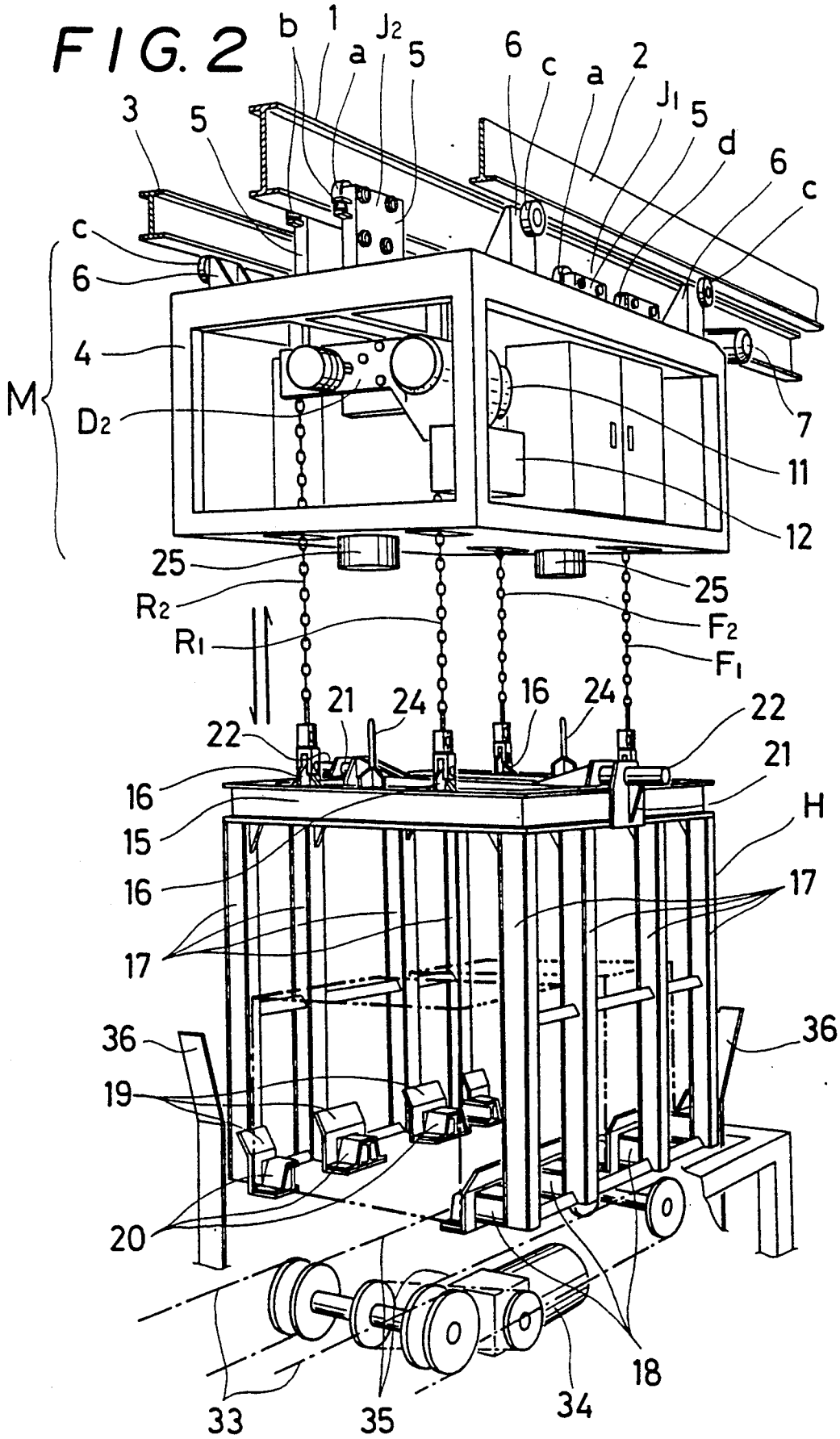
In FIG. 2 the monorail M is on a straight portion of the rail 1, and is above conveyors 33 and 35.
Figure 3:
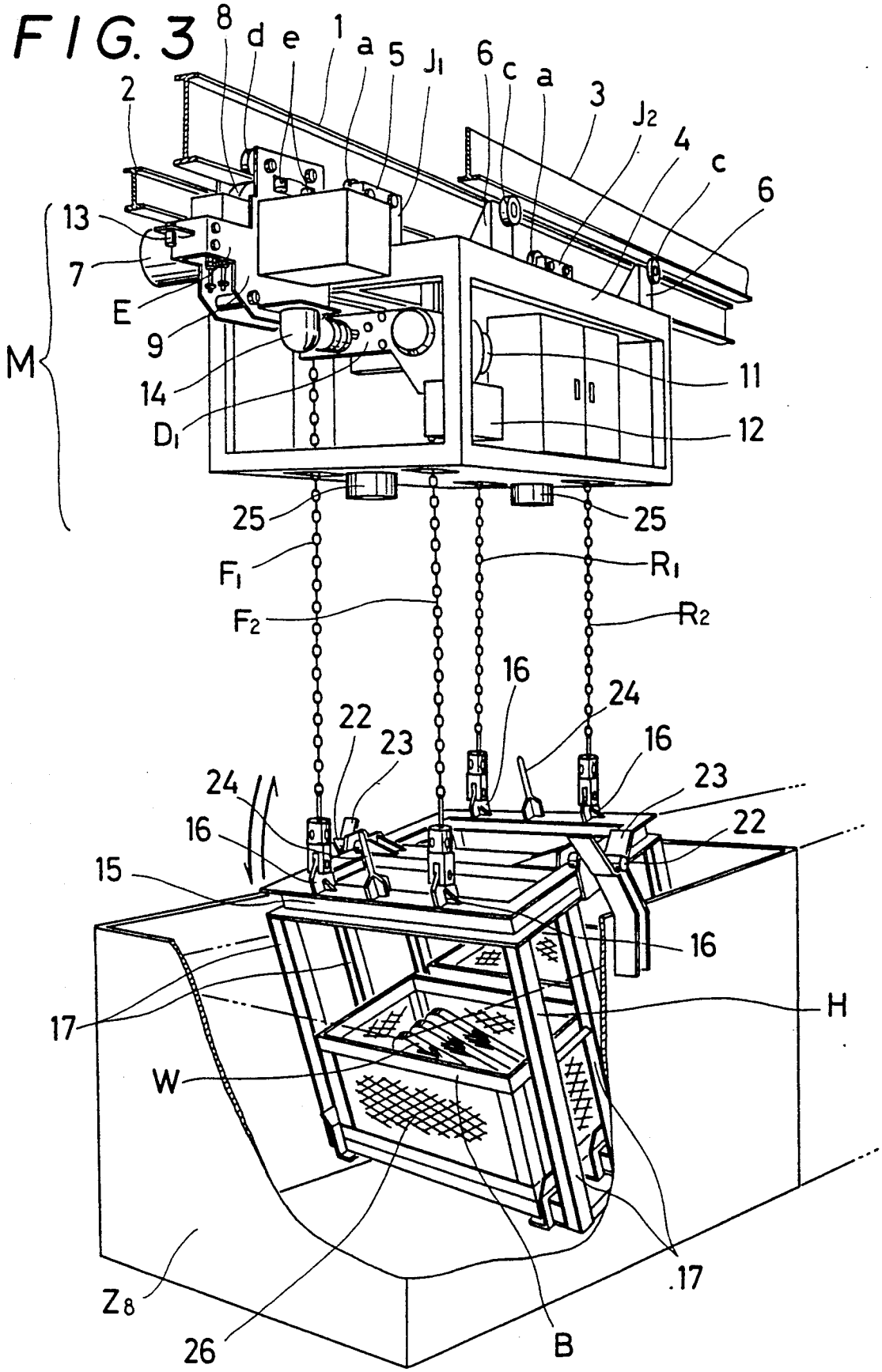
In FIG. 3 the hanger H is being rocked in a tank.

Referring to FIGS. 1, 2 and 3, a monorail M is suspended from an I-shaped central rail 1. Side rails 2 and 3 are provided on both sides of the central rail 1. The monorail M includes a rectangular frame 4. First and second suspensions $J_1$ and $J_2$ are located on the top of the frame 4, and are spaced apart from each other along the rail 1. Each suspension includes a pair of brackets 5 opposed to each other with the lower portion of the central rail 1 between. Two main rollers a spaced from each other along the rail 1 are connected to the interior of the bracket 5. In addition, two auxiliary rollers b are connected to the opposed sides of the bracket 5, respectively. Each main roller a rolls on the upper surface of the lower horizontal portion of the rail 1, while each auxiliary roller b rolls on an edge of the lower horizontal portion of the rail 1.

Four brackets 6 are also provided on the top of the frame 4. Two of the brackets 6 are located below one side rail 2, and the other two brackets 6 are located below the other side rail 3. Each bracket 6 is provided with a roller c which rolls on the bottom of the side rail. By rolling thereon, the roller c prevents the frame 4 from shaking during its travel along the rail or from rocking when a hanger H supporting works W, such as automobile parts, therein is rocked (as described later).

The monorail M also includes a locomotive E. The locomotive E has a frame 9 and an electric motor 7 projecting from the frame 9. The locomotive E also has four upper rollers d, a lower roller 8, and four side rollers e. Two of the four upper rollers d are located on one side of the vertical portion of the rail 1, while the other two upper rollers d are located on the opposed side of the vertical portion thereof. The upper rollers d roll on the upper surface of the lower horizontal portion of the rail 1. Two of the four side rollers e are located on one side of the rail 1 and roll on one edge of the lower horizontal portion of the rail 1, while the other two side rollers e are located on the opposed side of the rail 1 and roll on the opposed edge of the lower horizontal portion of the rail 1. The locomotive M also has a sensor 13 for preventing the monorail M from going against another monorail. Moreover, the locomotive M has a rotating lamp 14.

Figure 5:
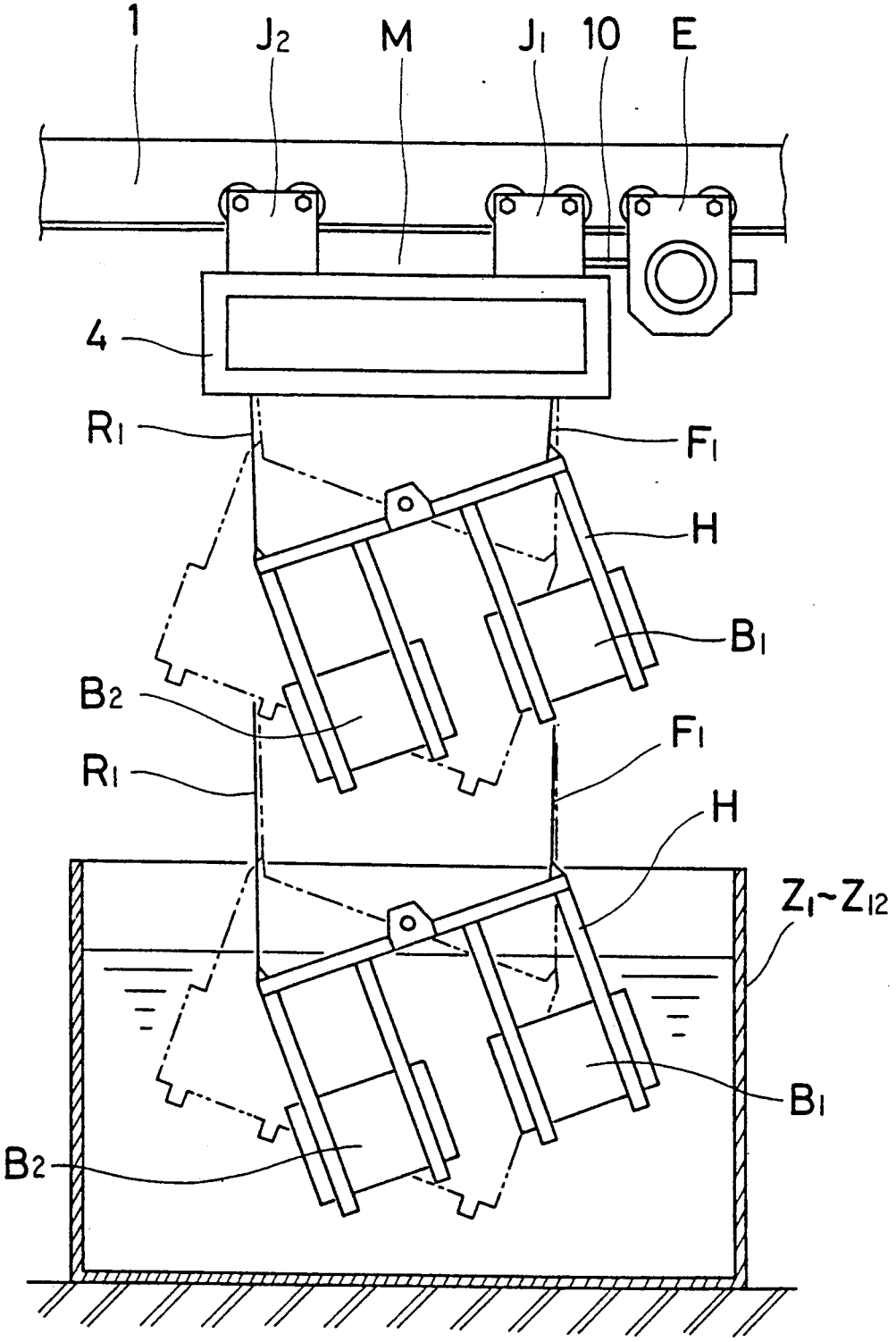
In FIG. 5 the monorail is above a tank.

As best shown in FIG. 5, the first suspension $J_1$ is connected to the locomotive E by means of a connecting member 10. Thus, when the locomotive E moves, the frame 4 moves with the locomotive E. The entire monorail M thus travels along the rail 1.

Two hoists $D_1$ and $D_2$ are provided in the frame 4. Each hoist has an electric motor 11. Two front chains $F_1$ and $F_2$ are suspended from the hoist $D_1$, while two rear chains $R_1$ and $R_2$ are suspended from the hoist $D_2$. One end of each front chain is located in a box 12, while one end of each rear chain is located in another box 12. The other end of each chain is connected to one of four brackets 16 fixed on the top of a hanger H. The hanger H is thus hung from the front and rear chains. Each hoist may comprise a drum (not shown) or a sheave (not shown) for winding up or drawing out the chains. The chains are drawn out (, or extended downward) by rotating the hoists in one direction, and are wound up by rotating the hoists in the opposite direction. If desired, wire ropes (not shown) may be used instead of the chains. In the illustrated embodiment, the two hoists are located in the front and rear spaces in the frame 4, respectively. However, if desired, the two hoists may be provided in the respective side spaces in the frame 4. Moreover, instead of providing two hoists one may provide four hoists in the respective corners in the frame 4.

The hanger H includes a top 15 and vertical members 17. From the lower end of each vertical member 17 inwardly projects a base member 8. A guide plate 19 and a basket support 20 are mounted on the base member 8. The hanger H also has opposed rods 22. As shown in FIG. 3, the rods 22 are supported on V-shaped supports 23 projecting upward from the top of each treating tank (as described later), especially those 23 projecting from the top of an electrodeposition coating tank $Z_8$. That is, when the hanger H is lowered into the tank, its rods 22 are supported on the V-shaped supports 23 and thus make it easy to rock the hanger H back and forth in the tank. From the top of the hanger H upwardly projects guide pins 24. In conjunction with the guide pins 24, stoppers 25 are connected to the bottom of the frame 4 of the monorail M. Each stopper 25 has an inner cone-shaped space. When the chains $F_1$, $F_2$, $R_1$, and $R_2$ are wound up, the hanger H moves upward until the guide pins 24 come into the inner spaces of the respective stoppers 25 and engage the respective stoppers 25. The hanger H is thus joined stably with the frame 4. Before the monorail M starts or restarts, the hanger H is thus joined with the frame 4.

Four of the eight supports 20 are used to support one basket B, and the other four supports 20 are used to support another basket B. Thus the hanger H carries two baskets B. Works W to be coated are loaded into each basket B. The four sides and bottom of the basket B may be constructed of wire nets 26 of expanded metal.

Figure 4:
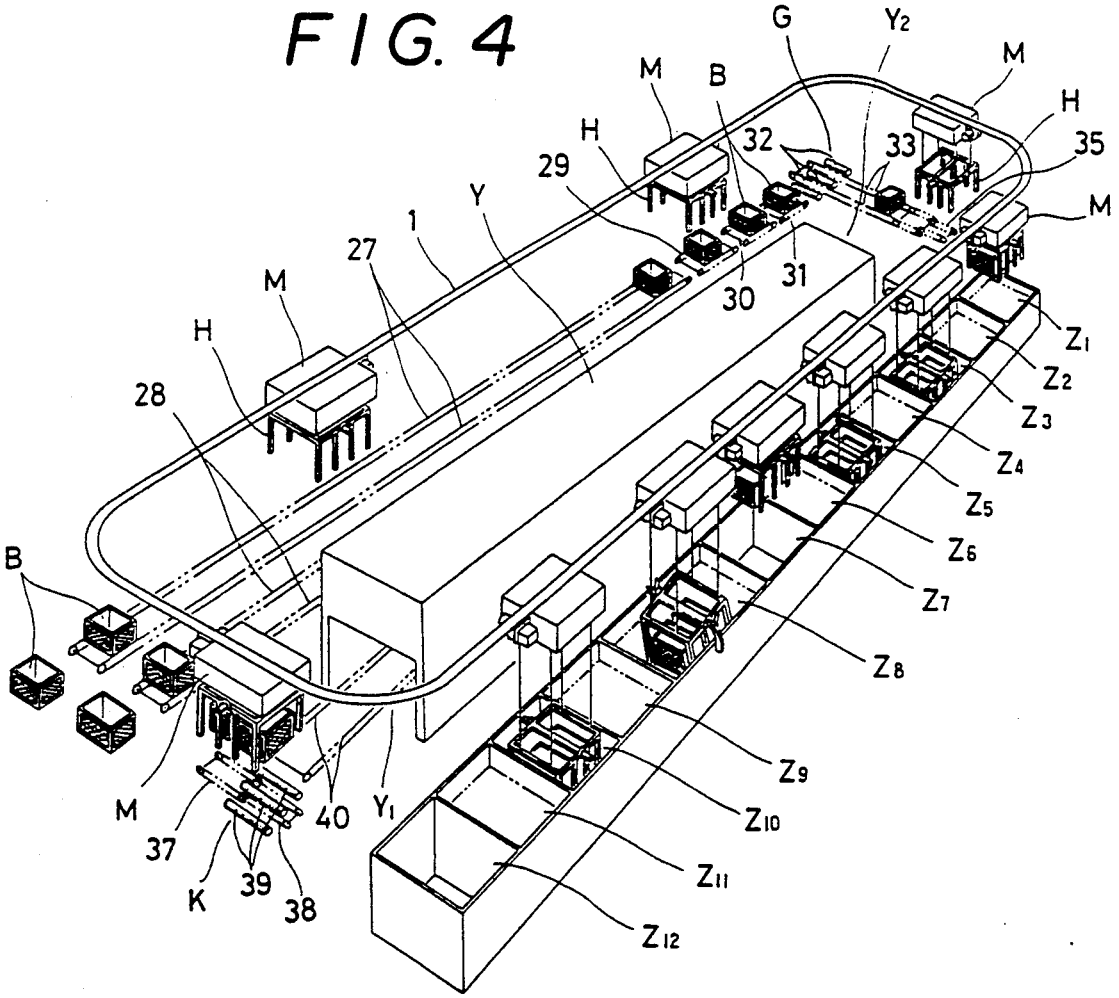
FIG. 4 shows an entire system used for the invention.

FIG. 4 shows the whole of a system used to carry out the electrodeposition coating method of the invention. The system of FIG. 4 may be constructed inside a building. In FIG. 4, although the rail is designated by reference numeral 1, it includes the side rails 2 and 3. As clearly shown, the rail 1 makes a loop. The rail 1 may be fixed to the ceiling of the building. Plural monorails M from which the hangers H are suspended are hung from the rail system 1. The letter Y designates a furnace for heating and drying works W coated in treating tanks $Z_1$ to $Z_{12}$. The furnace Y has an inlet $Y_1$ and an outlet $Y_2$.

Figure 6:
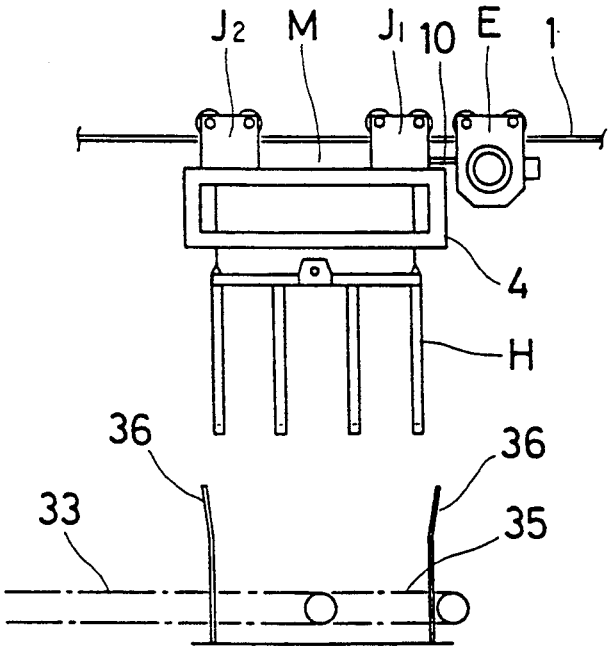
FIGS. 6(*a*) to 6(*e*) illustrate how to load baskets in the hanger H.
Figure 6:
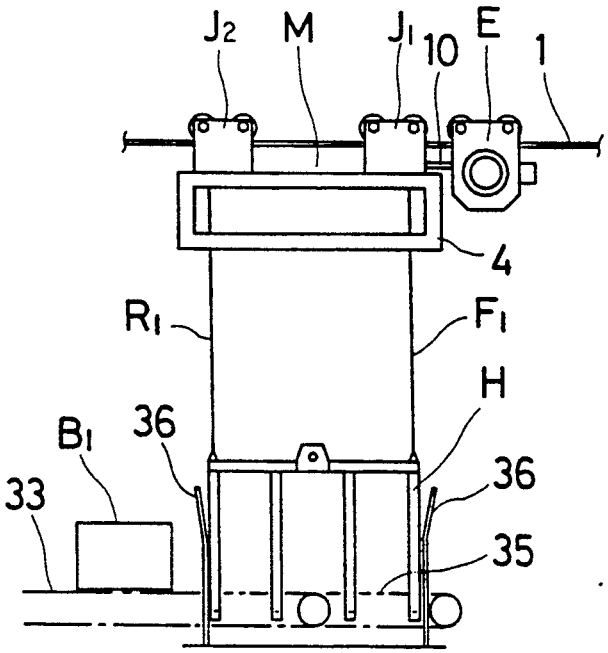
Figure 6:
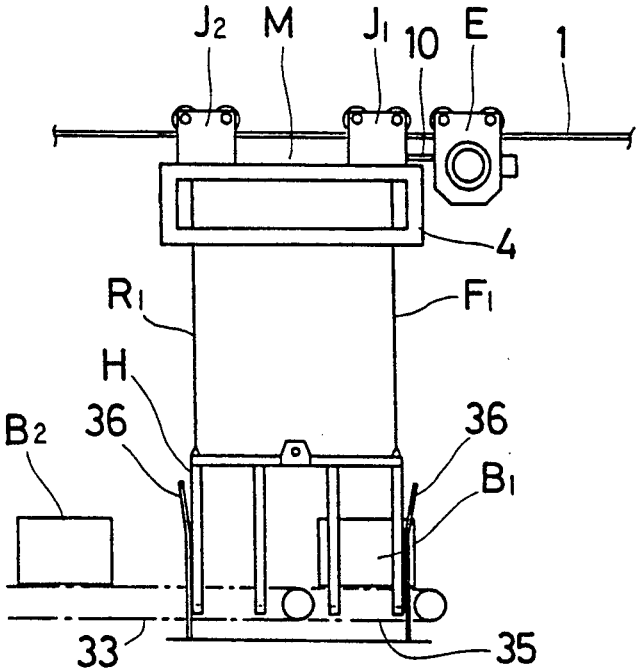
Figure 6:
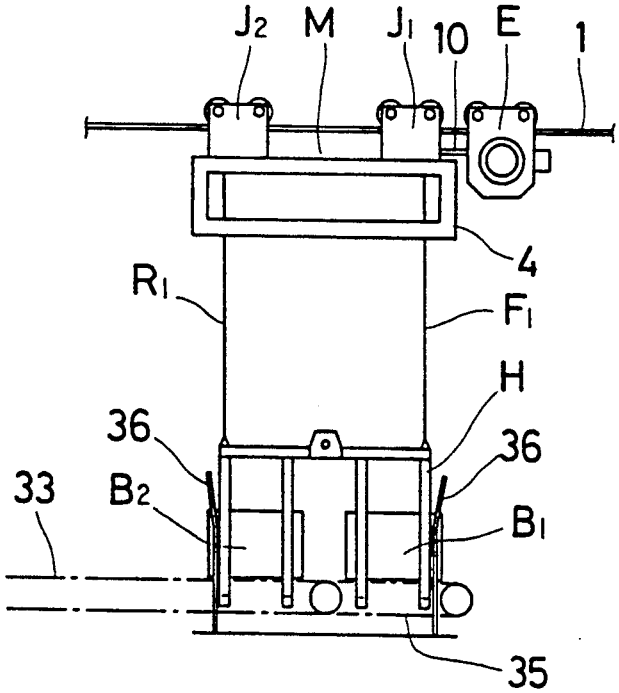
Figure 6:
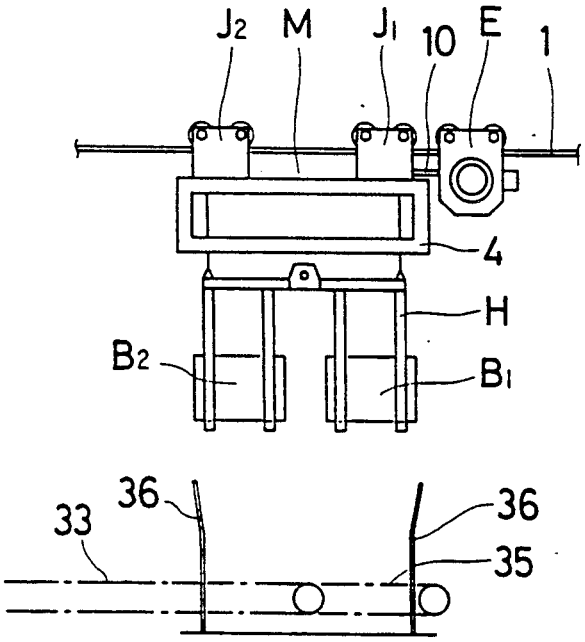

Reference numeral 27 designates a supply conveyor. In front of the supply conveyor 27 are located three short conveyors 29, 30, and 31. In front of the short conveyors are located three parallel basket-receiving rollers 32 connected together. The rollers 32 are vertically movable. A first loading conveyor 33 is located directly below part of the rail system 1, and overlaps with the rollers 32. The first loading conveyor 33 is located at a level slightly lower than the level of the rollers 32 when the rollers 32 have been raised to an upper position. As clearly shown, the first loading conveyor 33 extends perpendicular to the conveyors 27, 29, 30, and 31. In front of the first loading conveyor 33 is located a second loading conveyor 35. As best shown in FIGS. 6(*a*) to 6(*d*), the rear and of the second loading conveyor 35 and the front end of the first loading conveyor 33 are supported by a common spindle. The second loading conveyor 35 is operated by a motor 34 (FIG. 2). The second loading conveyor 35 is provided with two front guide plates 36 at its front portion. Also, the first loading conveyor 33 is provided with two rear guide plates 36 spaced apart from the front guide plates 36 by a distance substantially equal to the length of the hanger H. The guide plates 36 are located not in the centers of the conveyors 33 and 35, but on the sides thereof. FIG. 2 shows only one front guide plate 36 and only one rear guide plate 36. The function of the guide plates 36 is to make it easy to position the hanger H properly relative to the conveyors 33 and 35.

Tanks $Z_1$ to $Z_{12}$ are located directly below a straight portion of the rail 1. In each tank, works W are treated as follows:

In $Z_1$ the works W are showered to degrease them preliminarily.

In $Z_2$ they are alkaline degreased.

In $Z_3$, $Z_4$, and $Z_5$ they are showered or immersed in water to wash them.

In $Z_6$ they are washed with very clean water.

In $Z_7$ the water is removed from them. The tank $Z_7$ contains no liquid.

In $Z_1$ to $Z_7$ they are thus conditioned for electrodeposition coating. In each of the tanks $Z_1$ to $Z_7$ they are treated for about one minute.

In $Z_8$ they are immersed in paint for about four minutes to electrodeposition coat them with the paint.

In $Z_9$, $Z_{10}$, and $Z_{11}$ they are washed with water.

Finally, in $Z_{12}$ the water is removed from them. The tank $Z_{12}$ contains no liquid.

In each of the tanks $Z_9$ to $Z_{12}$ the works are treated for about one minute.

Figure 7:
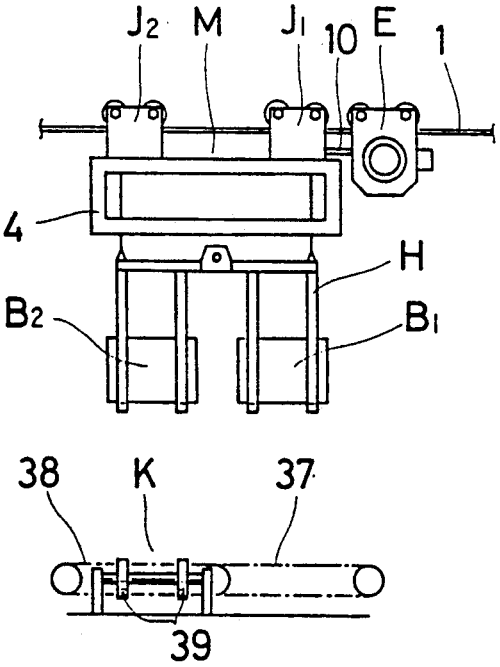
FIGS. 7(*a*) to 7(*e*) illustrate how to unload the baskets from the hanger H.
Figure 7:
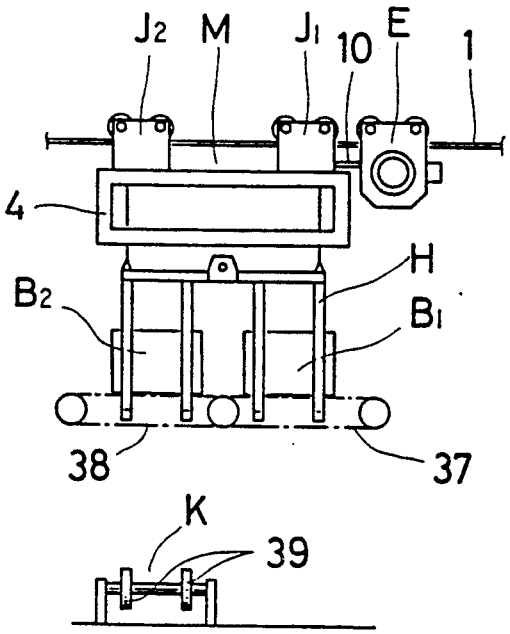
Figure 7:
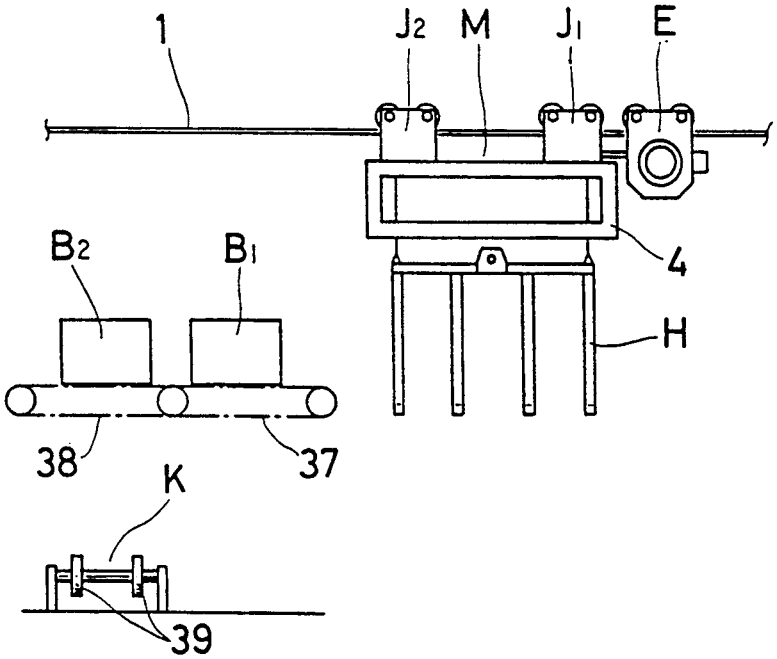
Figure 7:
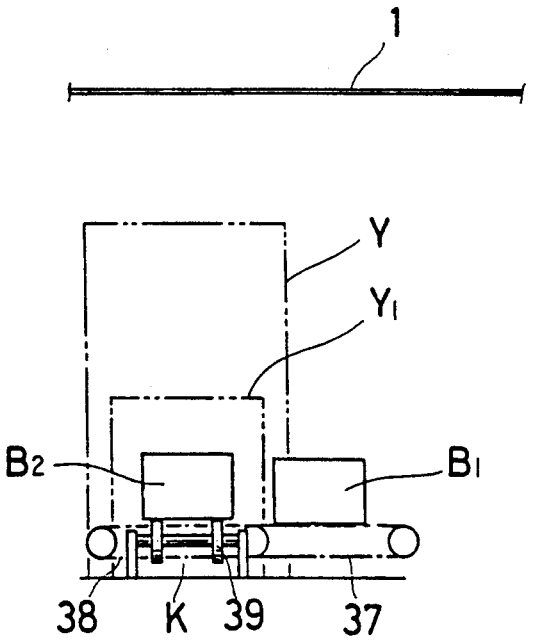
Figure 7:
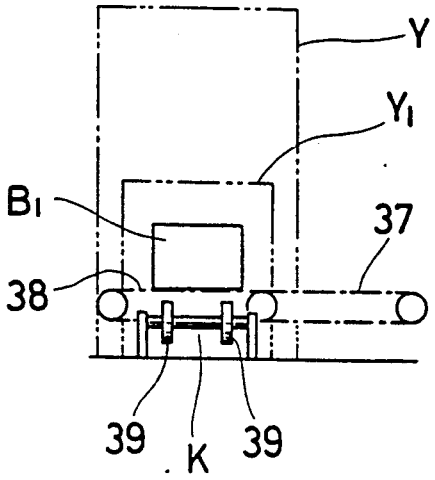

In front of the inlet $Y_1$ of the furnace Y is located first and second unloading conveyors 38 and 37. As clearly shown in FIGS. 7(*a*) to 7(*e*), one end of the first unloading conveyor 38 and one end of the second unloading conveyor 37 are supported by a common spindle. Also as shown in FIGS. 7(*a*) to 7(*e*), the two unloading conveyors 37 and 38 are vertically movable. A conveyor 40 extends through the inlet $Y_1$ of the furnace Y. Directly in front of the front end of the conveyor 40 is located three basket-receiving rollers 39. As clearly shown in FIG. 7(*a*), the first unloading conveyor 38 initially overlaps with the rollers 39.

Referring to FIG. 4, in use, works W to be electrodeposition coated, such as forgings or castings, are loaded into baskets B, and the baskets B are manually placed successively on one end of the supply conveyor 27. The baskets B are conveyed by the conveyor 27. After reaching the other end of the conveyor 27, the basket is transferred therefrom onto the conveyor 29, and thence onto the conveyor 30, and thence onto the conveyor 31.

The vertically-movable rollers 32 are initially in an upper position. From the conveyor 31 the basket is moved onto the rollers 32. Then, the rollers 32 are lowered to place the basket on one end of the first loading conveyor 32.

As shown in FIG. 6(*a*), a monorail M is above the first and second loading conveyors 33 and 35. As shown in FIG. 6(*b*), when the monorail M is in this position, the hanger H is lowered until the lower end of the hanger H comes into the conveyors 33 and 35 and becomes substantially flush with the lower surfaces of the conveyors 33 and 35. The hanger H is lowered exactly to the position of FIG. 6(*b*) by virtue of the guide plates 36.

Then, the first loading conveyor 32 is operated to convey the basket toward the hanger H. In FIG. 6(*b*) the basket is designated by $B_1$. Soon after the first loading conveyor 32 has been operated, the second loading conveyor 32 is also operated. Thus, as shown in FIG. 6(*c*), the basket $B_1$ reaches the second loading conveyor 35. Following this, as shown in FIG. 6(*d*) the next basket B is conveyed to the front end of the first loading conveyor 33.

Then, as shown in FIG. 6(*e*), the hanger H is raised. Thus, the basket supports 20 provided at the lower end of the hanger H come into engagement with the bottoms of the baskets $B_1$ and $B_2$, and support the baskets in this manner while the hanger H is raised. The baskets are thus lifted away from the conveyors 33 and 36. The basket supports 20 keep supporting the baskets $B_1$ and $B_2$ in this manner until the baskets are unloaded from the hanger H. As described before, four of the eight supports 20 support one basket $B_1$, and the other four supports 20 support the other basket $B_2$. Each basket is provided at its bottom with recesses (not shown) which receive the respective basket supports 20. Therefore there is no possibility that the baskets may drop from the hanger H.

The hanger H is raised until the guide pins 24 engage with the stoppers 25 provided on the bottom of the monorail M. The hanger H is thus joined stably with the monorail M.

Then, the monorail M starts. Thereupon, a next monorail M comes to the loading position of FIG. 6(*a*) to be loaded with baskets in the same manner as the preceding monorail.

When the monorail M has come to the position directly above the first tank $Z_1$, the monorail M stops. Then, the hanger H is lowered into the tank. Then, the works W are showered while the hanger H is rocked back and forth a number of times. The rocking of the hanger H is made by first winding up the front chains $F_1$ and $F_2$ or the rear chains $R_1$ and $R_2$ a little and then fully extending them again while winding up the other chains ($F_1$, $F_2$ or $R_1$, $R_2$) a little.

Needless to say, the hanger H is rocked for such angles that the works W are not thrown off the baskets.

Rocking the hanger H moves each work W in the baskets at random. Therefore each work W in the baskets changes its exposed surface as the hanger H is rocked. As a result, the entire surface of each work is showered.

When the works W have thus been treated, the hanger H is raised out of the tank $Z_1$. Then, the hanger H is rocked back and forth again as shown in FIG. 5. As a result, the water which has been used to shower the works and may still remain on or in the works is removed, or dropped, into the tank $Z_1$.

Then, the hanger H is returned completely to the uppermost position. That is, it is raised until the guide pins 24 engage with the stoppers 25. Then, the monorail M moves to the position directly above the second tank $Z_2$. Then, the hanger H is lowered into the second tank $Z_2$, and the works are alkaline degreased while the hanger H is rocked back and forth. When the works have been treated, the hanger H is raised out of the tank and is rocked back and forth to remove the liquid used to treat the works.

Thus, when the monorail M has come to the position directly above each tank, the monorail M stops and the hanger H is lowered into the tank and is rocked twice before it has been returned to the uppermost position, i.e., first in the tank for the treatment of the entire surface of each work and then above the tank for the removal of the liquid used, except that the hanger H is not rocked, but is returned straight to the uppermost position after it has been rocked in the tanks $Z_7$ and $Z_{12}$. The tanks $Z_7$ and $Z_{12}$ contain no liquid, nor is any liquid applied to the works when the works are in the two tanks. When the works are in the two tanks, the liquids used in the preceding tanks are only removed therefrom by rocking the hanger.

Thus, following treatment of the works in each tank, the liquid that has been used for the treatment and may still on or in the works is dropped into the same tank. Therefore the liquid used for the treatment of the works in each tank is not carried into the next tank.

In particular, after the works have been washed in the tank $Z_6$, they are rocked twice, i.e., first above the tank Z6 and then in the next tank $Z_7$, to drop from the works the water used in the tank $Z_6$. The possibility that the water contained in the tank $Z_6$ may be carried into the tank $Z_8$ (containing the paint used for the electrodeposition coating of the works) is, therefore, particularly excluded. Also, after the works have been washed in the tank $Z_{11}$, they are rocked twice, i.e., first above the tank $Z_{11}$ and then in the next tank $Z_{12}$.

The first and second unloading conveyors 38 and 37 are initially in a lower position, as shown in FIG. 7(*a*). Following treatment in the last tank $Z_{12}$, the works are conveyed to the position in front of the furnace Y. That is, following treatment of the works in the last tank $Z_{12}$, the monorail M comes to the position directly above the unloading conveyors 38 and 37, as shown in FIG. 7(*a*). When the monorail M has reached that position, it stops. Then, as shown in FIG. 7(*b*), the unloading conveyors 38 and 37 are raised to lift the baskets $B_2$ and $B_1$, respectively, away from the basket supports 20 of the hanger H. Thereupon, as shown in FIG. 7(*c*), the monorail M restarts. Then, as shown in FIG. 7(*d*), the conveyors 38 and 37 are lowered. As a result, as shown in FIG. 7(*d*), the basket B2 is placed on the rollers 39. Thereupon, the rollers 39 are rotated to transfer the basket B2 onto the conveyor 40, and then the basket B2 is moved into the furnace Y by the conveyor 40. Then, as shown in FIG. 7(*e*), the conveyors 38 and 37 are raised a little, and the conveyor 37 is rotated to move the basket B1 onto the conveyor 38. Thereupon, the conveyors 38 and 37 are lowered to place the basket B1 on the rollers 39. Thereupon, the rollers 39 are rotated to transfer the basket B1 onto the conveyor 40.

The upper space in the furnace Y is divided from the lower space therein by a floor member (not shown). Also, a conveyor (not shown) is provided in the upper space, and extends from end to end of the upper space. In addition, in the furnace Y, a front elevator (not shown) is provided near the inlet $Y_1$, and a rear elevator (not shown) is provided near the outlet $Y_2$.

Immediately after entering the furnace Y, the basket is lifted to its upper space by the front elevator, and is conveyed therethrough. As it is conveyed therethrough, the works W in it are heated and dried. When the basket has reached the rear end of the upper space, the basket is lowered by the rear elevator and is moved outside the furnace Y from its outlet $Y_2$. Then, the basket is transferred onto a conveyor located between the furnace Y and the supply conveyor 27.

As described before, in the illustrated embodiment the monorail M is moved by the locomotive E. If desired, however, the locomotive E may be omitted and instead the suspension $J_1$ or and $J_2$ may be provided with a mechanism for moving the monorail M.

Also, if desired, a vehicle suspended from conveyor chains may be used instead of the monorail M. That is, conveyor chains may be provided along the rail 1, and a vehicle from which the hanger H is hung may be suspended from the conveyor chains. In this case, the vehicle is moved with the conveyor chains by operating the conveyor chains.

Also, if desired, the hanger H may be entirely omitted and instead the baskets may be hung directly from the chains $F_1$, $F_2$, $R_1$, and $R_2$.

What is claimed is:

1. A process for electrodeposition coating works with paint which includes moving a basket containing the works along a series of tanks, stopping the basket when the basket has reached the desired position above each of the tanks, lowering the basket into each of the tanks, and treating the works while in the basket with a liquid in each of the tanks, the improvement comprising rocking the basket while it is in the tank and in addition rocking the basket when it rises above the tank in which the works have been treated to thereby cause the liquid remaining on or in the works to drop back into the tank.

2. A process in accordance with claim 1 wherein a monorail suspended from and moving along an overhead track is used to carry the basket, the basket being hung from a plurality of electrically operated hoists associated with the monorail, and operating said hoists to both move the basket vertically and to rock it.

3. A process in accordance with claim 2 wherein the basket is hung from chains suspended from the respective hoists.

4. A process in accordance with claim 2 wherein the basket is hung from wire ropes suspended from the respective hoists.

5. A process for electrodeposition coating works with paint which includes loading a basket containing works in a hanger, moving the hanger along a series of tanks, stopping the hanger when the hanger has reached a position above each of the tanks, lowering the hanger into each of the tanks, and treating the works while in the basket with liquids in each of the tanks, the improvement comprising rocking the hanger while it is in the tank and additionally rocking the hanger when it rises above the tank in which the works have been treated to thereby cause the liquid remaining on or in the works to drop back in the tank.

6. A process in accordance with claim 5 wherein a monorail suspended from and moving along an overhead track is used to carry the hanger, the hanger being hung from a plurality of electrically operated hoists associated with the monorail, and operating the hoists to both move the hanger vertically and to rock it.

7. A process in accordance with claim 5 wherein the hanger is hung from chains suspended from the respective hoists.

8. A process in accordance with claim 5 wherein the hanger is hung from wire ropes suspended from the respective hoists.

* * * * *